US007078142B2

(12) United States Patent
Itami et al.

(10) Patent No.: US 7,078,142 B2
(45) Date of Patent: Jul. 18, 2006

(54) IMAGE FORMING METHOD

(75) Inventors: Akihiko Itami, Hachioji (JP); Tomoo Sakimura, Hachioji (JP); Takeo Oshiba, Hachioji (JP); Yohko Kitahara, Hachioji (JP); Masahiko Kurachi, Hachioji (JP); Kazuhisa Shida, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/152,302

(22) Filed: May 21, 2002

(65) Prior Publication Data

US 2003/0049557 A1 Mar. 13, 2003

Related U.S. Application Data

(62) Division of application No. 09/551,475, filed on Apr. 18, 2000, now abandoned.

(30) Foreign Application Priority Data

Apr. 21, 1999 (JP) ..... 11-113618

(51) Int. Cl.
*G03G 21/10* (2006.01)

(52) U.S. Cl. ..... 430/125; 399/346; 399/350; 430/126

(58) Field of Classification Search ..... 430/126, 430/58.2, 58.7, 66, 125; 399/159, 346, 123, 399/350

See application file for complete search history.

(56) References Cited

U.S. PATENT DOCUMENTS

| | | | | |
|---|---|---|---|---|
| 4,869,982 | A * | 9/1989 | Murphy | 430/66 |
| 5,604,574 | A * | 2/1997 | Matsuura et al. | 430/125 |
| 5,716,752 | A * | 2/1998 | Ott et al. | 430/137.18 |
| 5,879,847 | A * | 3/1999 | Yoshinaga et al. | 430/58.2 |
| 6,118,964 | A * | 9/2000 | Kojima et al. | 361/225 |

OTHER PUBLICATIONS

Diamond, Arthur S. (editor) Handbook of Imaging Materials. New York: Marcel-Dekker, Inc. (1991) p. 169.*

* cited by examiner

*Primary Examiner*—Christopher RoDee

(74) *Attorney, Agent, or Firm*—Lucas & Mercanti, LLP

(57) ABSTRACT

An image forming method is disclosed. The method comprises processes in which a latent image on an electrophotographic photoreceptor is developed employing a developer material, and after transferring the visualized toner image to a recording material, the remaining toner on said photoreceptor is removed employing an elastic body cleaning blade. The electrophotographic photoreceptor comprises a surface layer containing a charge transportable polysiloxane hardenable resin, and said developer material comprises a fatty acid metal salt.

10 Claims, 4 Drawing Sheets

IMAGE FORMING METHOD

CROSS-REFERENCE TO RELATED APPLICATIONS.

This Application is a Divisional Application of U.S. patent application Ser. No. 09/551,475, filed Apr. 18, 2000.

FIELD OF THE INVENTION

The present invention relates to an image forming method, an image forming apparatus, a processing cartridge, and an electrophotographic photoreceptor.

BACKGROUND OF THE INVENTION

In recent years, as electrophotographic photoreceptors, organic photoreceptors comprising organic photoconductive materials have been widely employed. Organic photoreceptors are superior to other photoreceptors in such a manner that it is easier to develop materials in response to various types of exposure light sources ranging from visible light to infrared light; it is possible to select materials which result in no environmental pollution; the production cost is lower; and the like. However, the organic photoreceptors have problems in which their mechanical strength is low, and during copying a large volume, as well as during normal printing, the photoreceptor surface results in degradation as well as abrasion.

The aforementioned organic photoreceptor exhibits a large frictional resistance against a cleaning blade employed to remove residual toner. As a result, the surface of said photoreceptor is subjected to wear as well as abrasion.

On the other hand, in order to improve the mechanical strength of the electrographic photoreceptor, heretofore, various matters have been investigated.

Regarding mechanical durability, it is reported that by employing bisphenol Z type polycarbonates as a binder, the surface frictional properties as well as toner filming properties are improved. Further, Japanese Patent Publication Open to Public Inspection No. 6-118681 discloses that colloidal silica containing hardenable silicone resin is employed as the surface layer of a photoreceptor.

However, the photoreceptor, in which bisphenol type polycarbonate binder is employed, exhibits neither sufficient wear resistance properties nor sufficient durability. On the other hand, wear resistant properties of the surface layer comprised of colloidal silica containing hardenable resin are improved. However, during repeated use, electrophotographic properties are not sufficient, and background staining as well as image blurring result. Thus, sufficient durability is not obtained.

As one of several methods to overcome such problems, an attempt has been carried out in which fatty acid metal salts are incorporated into the developer material, and during development, a thin layer of said fatty acid metal salt is formed on the photoreceptor surface to decrease the frictional resistance against said cleaning blade. However, when this method is employed, the surface of a conventional photoreceptor suffers from a large decrease in layer thickness due to wear, and further, the decrease in the frictional resistance due to the formation of the thin layer of fatty acid salt exhibits only temporary effects.

Further, as a method to overcome the aforementioned problems, the inventors of the present invention proposed a charge transferable polysiloxane hardenable resin layer as the surface layer of a photoreceptor (Japanese Patent Application No. 11-70308). The wear resistance as well as ambient resistance (variations of electrostatic properties with respect to temperature and humidity) is improved. However, when structure units having a charge transferability were built in, it was found that problems occurred in which the wear of the edge of a cleaning blade was greater, being different from conventional organic photoreceptors, especially at high temperature and high humidity ambience (hereinafter referred to as HH ambience) and cleaning properties at the HH ambience were degraded.

SUMMARY OF THE INVENTION

It is an object of the present invention to provide an image forming method and an image forming apparatus which are capable of providing consistent electrophotographic images with high quality for a long period of time, and a processing cartridge as well as an electrophotographic photoreceptor which are employed in said apparatus. It is another object of the present invention to provide an image forming method as well as an image forming apparatus which exhibits excellent cleaning properties at high temperature and high humidity and is capable of providing excellent electrophotographic images, and a processing cartridge as well as an electrophotographic photoreceptor employed in said apparatus.

The present invention will be described below.

In an image forming method comprising processes in which a latent image on an electrophotographic photoreceptor is developed employing a developer material, and after transferring the visualized toner image to a recording material, the remaining toner on said photoreceptor is removed employing an elastic body cleaning blade, an image forming method wherein said electrophotographic photoreceptor comprises a surface layer containing a charge transportable polysiloxane hardenable resin, and said developer material comprises a fatty acid metal salt.

In an image forming method comprising processes in which a latent image on an electrophotographic photoreceptor is developed employing a developer material, after transferring the visualized toner image to a recording material, the remaining toner on said photoreceptor is removed employing an elastic body cleaning blade, an image forming method wherein said electrophotographic photoreceptor comprises a surface layer containing a charge transportable polysiloxane hardenable resin, and an image is formed while supplying a fatty acid metal salt to the surface of said photoreceptor via an auxiliary cleaning member.

In an image forming method comprising processes in which a latent image on an electrophotographic photoreceptor is developed employing a developer material, and after transferring the visualized toner image to a recording material, the remaining toner on said photoreceptor is removed employing an elastic body cleaning blade, an image forming method wherein said electrophotographic photoreceptor comprises a surface layer containing a charge transportable polysiloxane hardenable resin and a fatty acid metal salt.

The charge transportable polysiloxane hardenable resin is preferably a polysiloxane hardenable resin comprising a charge transportability providing group as a partial structure.

The bleeding rate of the fatty acid metal salt, which is measured employing a flow tester, is preferably at least $5.0\times10^{-4}$ ml/second.

The elastic body rubber blade is preferably composed of polyurethane rubber having an impact resilience of 20 to 60 at 20° C. and 50±5% RH.

The surface layer preferably comprises antioxidants.

The charge transportable polysiloxane hardenable resin is preferably a reaction product of an organic silicon compound having a hydroxyl group or a hydrolyzable group with a charge transportable compound having a hydroxyl group.

In an image forming apparatus in which a latent image on an electrophotographic photoreceptor is developed employing a developer material, after transferring the visualized toner image to a recording material, the remaining toner on said photoreceptor is removed employing an elastic body cleaning blade, an image forming apparatus characterized in that said electrophotographic photoreceptor comprises a surface layer containing a charge transportable polysiloxane hardenable resin, and said developer material comprises a fatty acid metal salt.

In an image forming apparatus in which a latent image on an electrophotographic photoreceptor is developed employing a developer material, and after transferring the visualized toner image to a recording material, the remaining toner on said photoreceptor is removed employing an elastic body cleaning blade, an image forming apparatus characterized in that said electrophotographic photoreceptor comprises a surface layer containing a charge transportable polysiloxane hardenable resin, and an image is formed while supplying a fatty acid metal salt to the surface of said photoreceptor via an auxiliary cleaning member.

In an image forming apparatus in which a latent image on an electrophotographic photoreceptor is developed employing a developer material, and after transferring the visualized toner image to a recording material, the remaining toner on said photoreceptor is removed employing an elastic body cleaning blade, an image forming apparatus characterized in that said electrophotographic photoreceptor comprises a surface layer containing a charge transportable polysiloxane hardenable resin, and a fatty acid metal salt.

In a processing cartridge employed in an image forming apparatus in which a latent image on an electrophotographic photoreceptor is developed employing a developer material, and after transferring the visualized toner image to a recording material, the remaining toner on said photoreceptor is removed employing an elastic body cleaning blade, a process cartridge which integrally comprises at least an electrophotographic photoreceptor comprising a surface layer containing a charge transportable polysiloxane hardenable resin, said elastic body blade, and an auxiliary cleaning member which supplies a fatty acid metal salt to the surface of said photoreceptor.

An electrophotographic photoreceptor comprising a surface layer containing a charge transportable polysiloxane hardenable resin as well as a fatty acid metal salt.

DETAILED DESCRIPTION OF THE INVENTION

Figure 1:
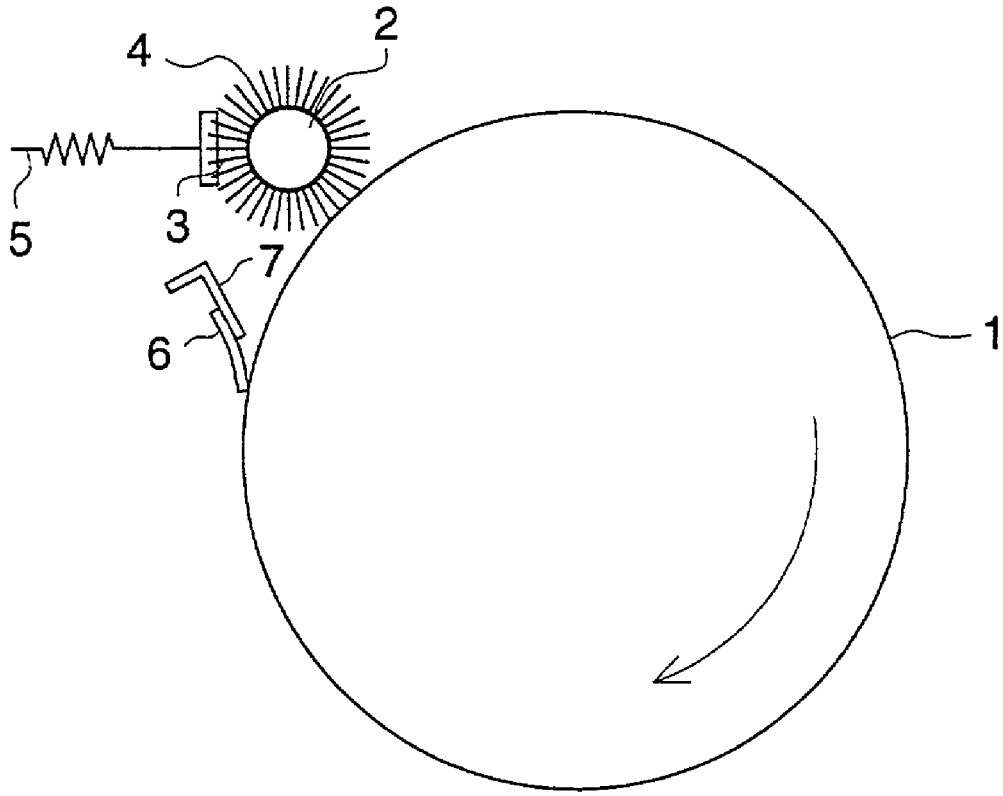
FIG. 1 is a cross-sectional view showing an example in which a solid member comprised of fatty acid metal salts is employed as a flicker.

The present invention will now be detailed below.

The present invention has been achieved by discovering that an electrophotographic photoreceptor having a surface layer comprised of charge transportable polysiloxane hardenable resins (hereinafter occasionally referred to as charge transportable polysiloxane hardening resins) uniquely exhibit high affinity with fatty acid metal salts, and a thin fatty acid metal salt layer can be uniformly formed on the surface of the photoreceptor. In conventional organic photoreceptors, even though such a thin fatty acid metal salt layer is formed, the formation is temporary and its effects do not last. However, in the photoreceptor in which auxiliary charge transportable polysiloxane hardenable resins are employed, a thin fatty acid metal salt layer is obtained which is stable for an extended period of time. Specifically, by employing the methods described below, the present invention is effectively practiced.

Fatty acid metal salts are incorporated into a developer material.

Fatty acid metal salts are incorporated into the surface layer of a photoreceptor.

Fatty acid metal salts are supplied to the surface of a photoreceptor via an auxiliary cleaning member.

The aforementioned fatty acid metal salts are preferably those of saturated or unsaturated fatty acids having at least 10 carbon atoms. Examples include aluminum stearate, indium stearate, gallium stearate, zinc stearate, lithium stearate, magnesium stearate, sodium stearate, aluminum palmitate, aluminum oleate, and the like. The stearic acid metal salts are more preferred.

Of listed fatty acid metal salts, those having a higher bleeding rate as measured by a flow tester, exhibit especially high cleavage properties, and are capable of more effectively forming a fatty acid metal salt layer on the surface of the aforementioned photoreceptor of the present invention. Said bleeding rate is preferably between $5\times10^{-4}$ and $1\times10^{-2}$, and is most preferably between $5\times10^{-4}$ and $1\times10^{-2}$. The bleeding rate of the flow tester is measured employing a Shimadzu Flow Tester "CFT-500" (manufactured by Shimadzu Seisakusho Co., Ltd.)

Each of several supplying means of fatty acid metal salts will be described below.

When the fatty acid metal salts are incorporated into the developer material, said fatty acid metal salts are preferably mixed with toner, stirred and dispersed during the post process of said toner. The added amount depends on the particle diameter of the toner and the like. However, when the toner has a common particle diameter (volume average particle diameter) of 2 to 15 μ, the added amount is preferably between 0.01 and 1 percent by weight. When the added amount of fatty acid metal salts is no more than 0.01 percent by weight, migration from the toner surface to the photoreceptor surface is insufficient and it is difficult to form a thin layer on said photoreceptor. On the other hand, when the added amount exceeds one percent by weight, the adhesion amount of paper dust onto the thin fatty acid metal salt layer formed on the photoreceptor surface increases and blurred images tend to be formed.

From the viewpoint of providing fluidity to toner, fine inorganic particles as well as fine organic particles are incorporated into said toner, and mixing and stirring processes are preferably repeated. In this case, particularly, the fine inorganic particles are preferable, and silica, titania, alumina, and the like are preferably employed. Further, these fine inorganic particles are preferably subjected to hydrophobic treatment employing silane coupling agents, titanium coupling agents, and the like.

Next, when fatty acid metal salts are incorporated into the surface layer of the present photoreceptor, those salts may be dispersed into the surface layer coating composition of the present invention or dissolved in the same, as described below, coated and subsequently dried. The content of fatty acid metal salts in the surface layer of said photoreceptor is preferably between 0.1 and 10 percent by weight. When the content of said fatty acid metal salts is below 0.01 percent by weight, insufficient effects are obtained. Further, when the content exceeds 10 percent by weight, the adhesion of paper dust to the surface of said photoreceptor increases and image blurring tends to occur.

The photoreceptor, which contains a charge transferable polysiloxane hardenable resin at the surface layer is described.

In the invention, the cross-linked siloxane resin having the charge transportable structural unit can be prepared by a known method using an organic silicon compound having hydroxyl group or a hydrolyzable group. Such the organic silicon compound is represented by the following Formula A, B, C or D.

Formula A

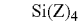

Formula B

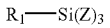

Formula C

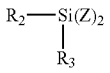

Formula D

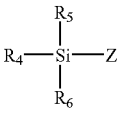

In the formulas, $R_1$ through $R_6$ are each an organic group in which a carbon atom thereof is directly boned with the silicon atom in the formula, X is a hydroxyl group or a hyrolyzable group.

When X in the above formulas is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by $R_1$ through $R_6$ in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β-(3,4-epoxycyclohexyl)ethyl group, an (metha)acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a nonafluorohexyl group and perfluorooctylethyl group, and an alkyl group substituted by a nitro group or a cyano group. The organic groups represented by $R_1$ through $R_6$ may be the same as or different from each other.

Generally, the reaction of the organic siloxane compound for preparing a charge transportable polysiloxane resin, that is also called as siloxane resin having structural unit capable of charge transferring property and crosslinking structure, is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling such the factors can control the storage ability of the coating liquid of the layer and the hardness of the coated layer.

The siloxane resin of the invention is a resin which is formed and hardened by a reaction (including a hydrolyzing, and a reaction in the presence of a catalyst or a cross-linking agent) of a monomer, an oligomer or a polymer having a siloxane bond in the chemical structural thereof unit to form a three-dimensional network structure.

In another words, the siloxane resin of the invention means a cross-linked siloxane resin formed as a result of the formation of three-dimensional network structure by acceleration of siloxane bonding formation of the organic compound having a siloxane bond by a hydrolyzing reaction and a dehydrating reaction.

Moreover, the siloxane resin may be a resin containing a silica particle as a part of the cross-linked structure by adding a colloidal silica particle having a hydroxyl group or a hydrolyzable group.

In other definition, the charge transportable structural unit is a chemical structural unit or a residue of charge transportable compound by which an electric current caused by charge transportation can be detected by a known method for detecting the charge transportation ability such as Time-Of-Flight method.

In the invention the cross-linked siloxane resin having a charge transportable structural unit is a siloxane resin in which a chemical structure showing a drift mobility of electron or a hole (i. e., the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

The charge transferable compound which can form a group having the charge transporting ability through reaction with an organic silicone compound as a structural unit in the cross-linked polysiloxane hardenable resin is described.

Examples of hole transporting type CTM which each are contained in the siloxane resin as the partial structure thereof are as follows: oxazole, oxadiazole, thiazole, triazole, imidazole, imidazolone, imidazoline, bisimidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM which each are contained in the siloxane resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalononitrile, polynitro-9-fluorenylidenedicyanomethylenemalono-dinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and mellitic acid.

In the invention, preferable charge transportable structural units are residues of usually used charge transporting compounds such as mentioned above. The residue is bonded with the bonding atom or group represented by Z through the carbon atom or the silicon atom constituting the charge transporting compound so as to be contained in the siloxane resin.

Formula 1

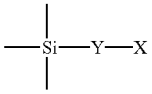

In the formula, Y is a bonding group having two or more valences.

When Y is three or more valent atom, the bonding hand other than those each bonding with Si and C is bonded with any atom constituting the hardened resin, or another atom or molecular group.

In the above-mentioned formula, the atom represented by Z is preferably an oxygen atom O, a sulfur atom S or nitrogen atom N.

In the formula, Y is a nitrogen atom (N), the above-mentioned bonding group is represented by —NR—, wherein R is a hydrogen atom or a mono-valent organic group.

Although the charge transportable structural unit X is shown as a mono-valent group in the formula, the structural unit may be bonded as a two or more valences cross-linking group in the hardened resin or as a simple pendant group when the charge transporting compounds to be reacted with the siloxane resin has two or more functional groups.

The O, S or N atoms is a bonding atom or group for taking the charge transportable structural unit into the siloxane resin, which is formed by reaction of a hydroxyl group, mercapto group or amine introduced into the charge transportable compound with the organic silicon compound having a hydroxyl group or a hydrolyzable group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$X—(R_7—OH)_m$ $m \geqq 1$ wherein

X: structural unit providing charge transportability $R_7$: single bonding group, each of a substituted or an unsubstituted alkylene or arylene group m: preferably 1 to 5

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds

T-1

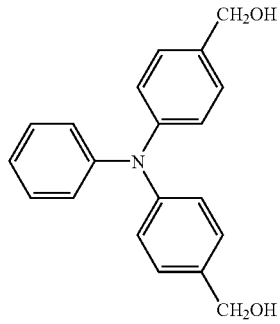

T-2

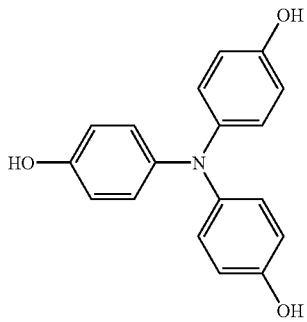

T-3

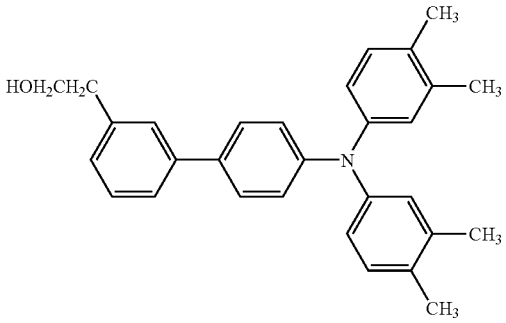

T-4

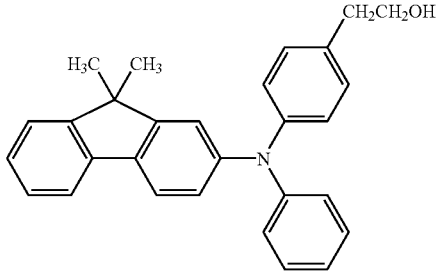

H-1
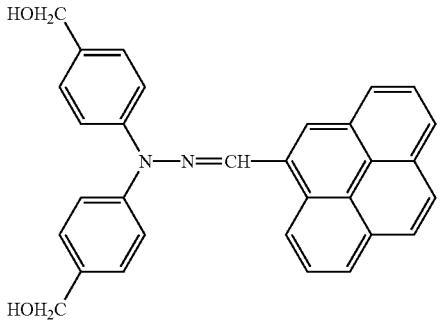
H-2
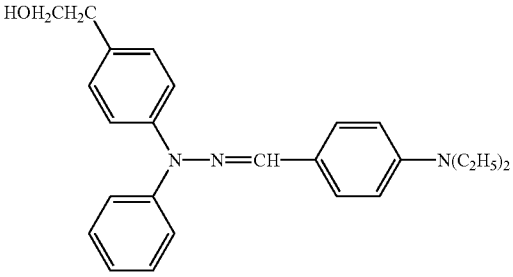
H-3
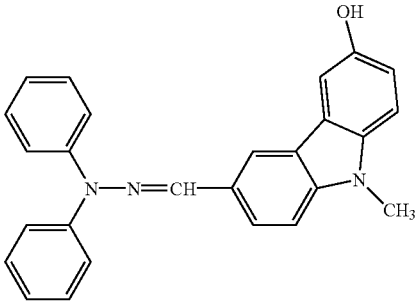
3. Stilbene Based Compounds
S-1
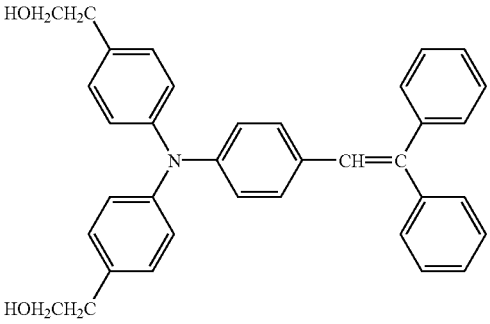
-continued
S-2
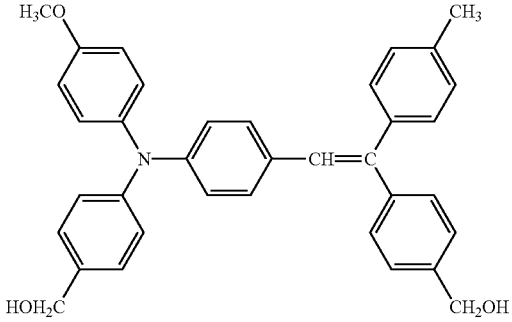
S-3
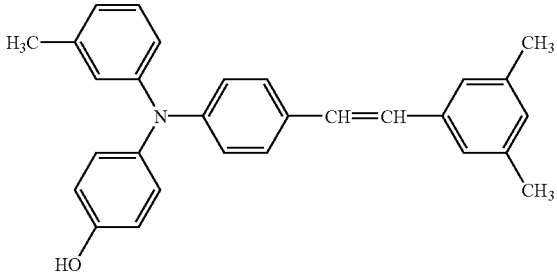
4. Benzidine Based Compounds
Be-1
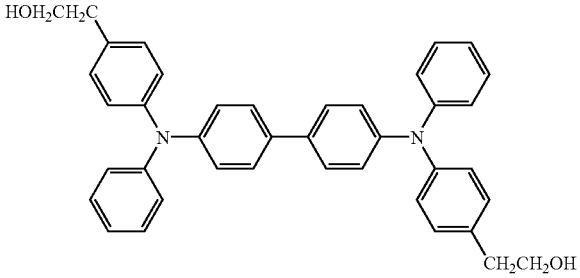
Be-2
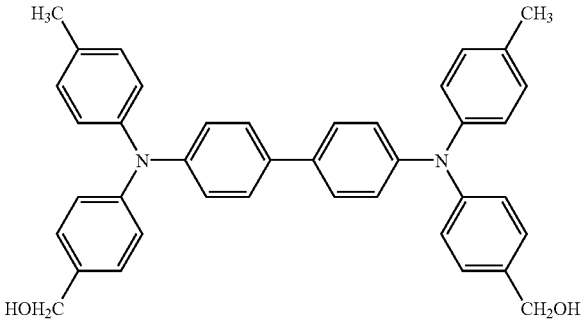
5. Butadiene Based Compounds Bu-1

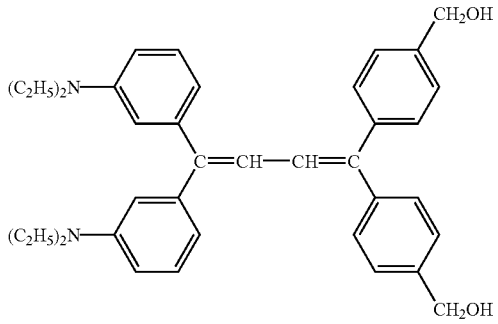

6. Other Compounds

So-1

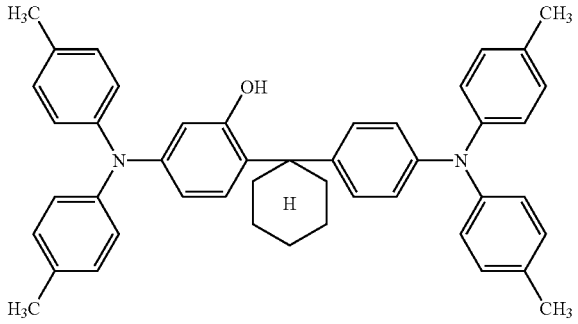

So-2

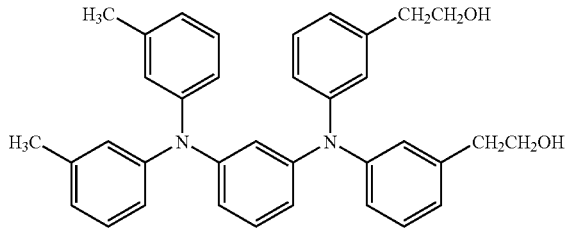

Next, a synthesis example of the charge transportable compound will be described.

Synthesis of Exemplified Compound T-1

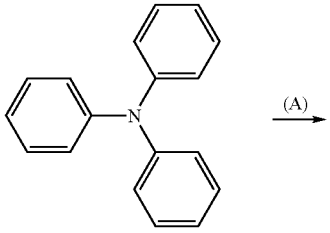

(1)

-continued

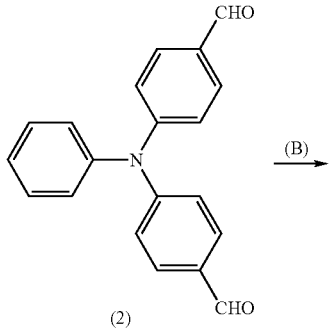

(2)

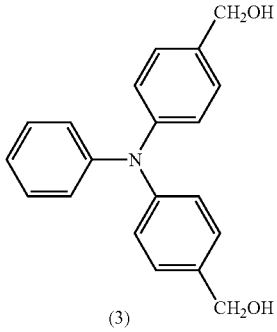

(3)

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the reaction solution, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

Synthesis of Exemplified Compound S-1

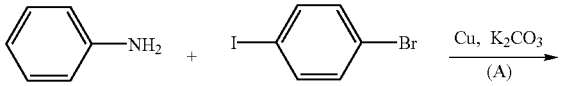

(1) (2)

-continued

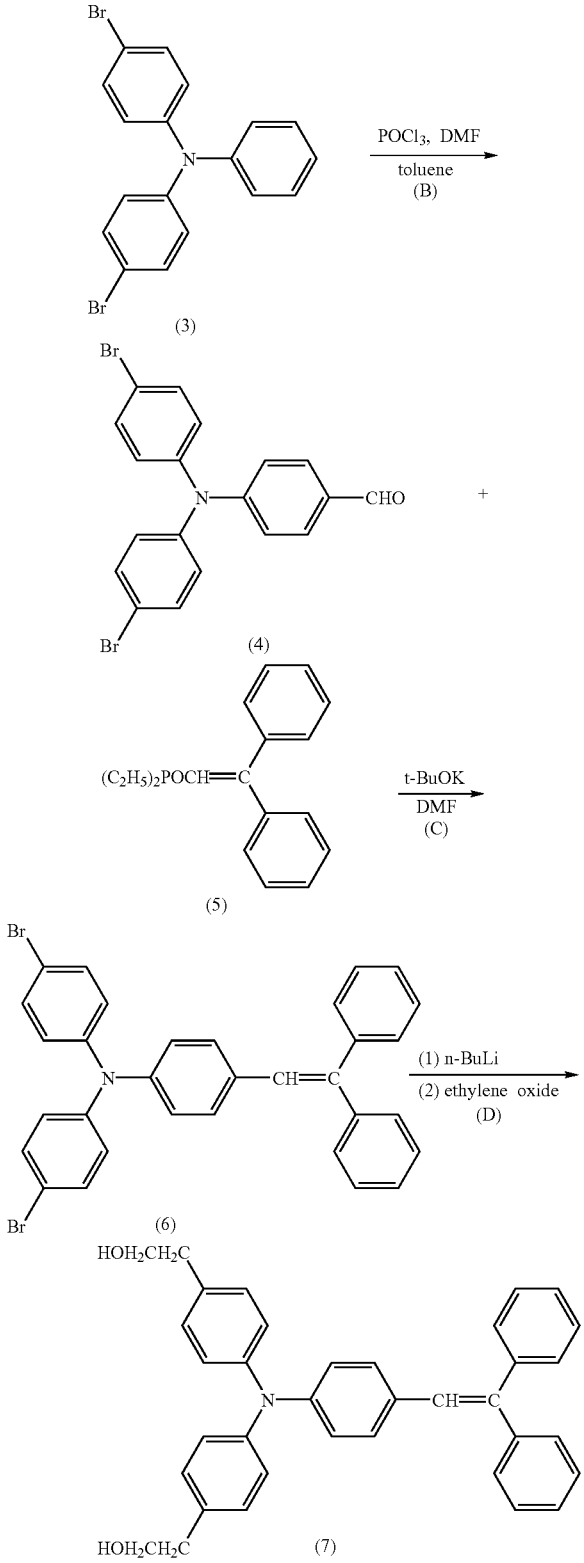

Step A

Placed in a 300 ml flask equipped with a thermometer and a stirrer were 30 g of Cu, 60 g of $K_2CO_3$, 8 g of Compound (1), and 100 g of Compound (2) and the resulting mixture was heated to about 180° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R_8—SH)_m \quad m \geqq 1$$

wherein

X: charge transportability providing group $R_8$: single bonding group, each of a substituted or an unsubstituted alkylene group or an arylene group m: preferably 1 to 5

Of these, listed as representative compounds are such as those described below.

V-1

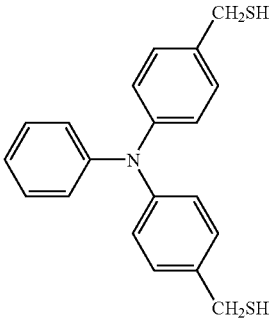

V-2

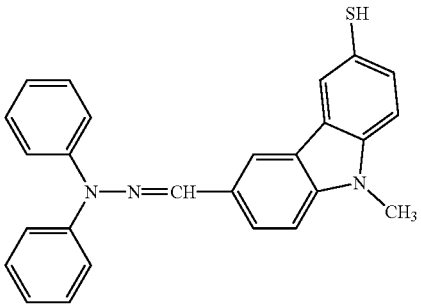

V-3

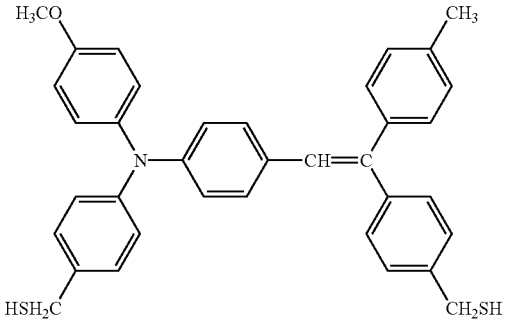

V-4

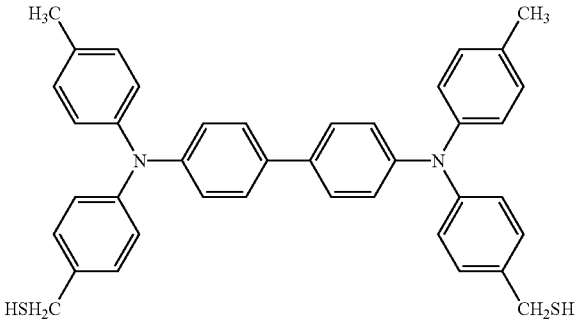

-continued

V-5

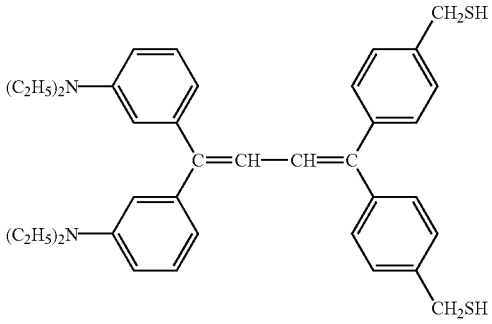

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_9—NR_{10}H)_m \quad m \geqq 1$$

wherein

X: charge transportability providing group $R_9$: single bonding group, each of a substituted or an unsubstituted alkylene group or an arylene group $R_{10}$: H, a substituted or unsubstituted alkyl group, a substituted or an unsubstituted aryl group m: 1 to 5

Of these, listed as representative compounds are such as those described below.

W-1

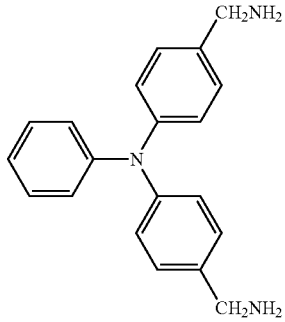

W-2

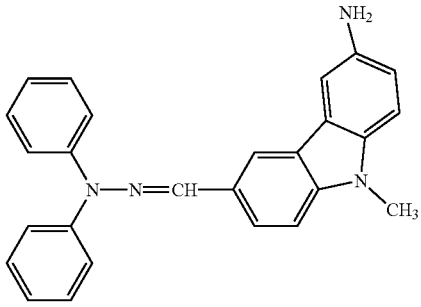

-continued

W-3

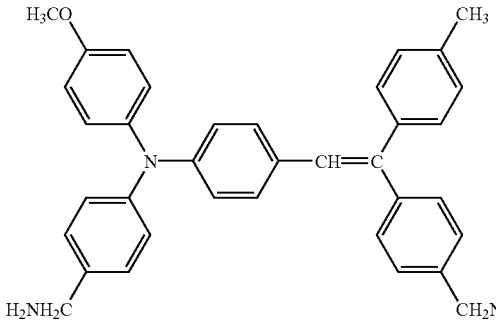

W-4

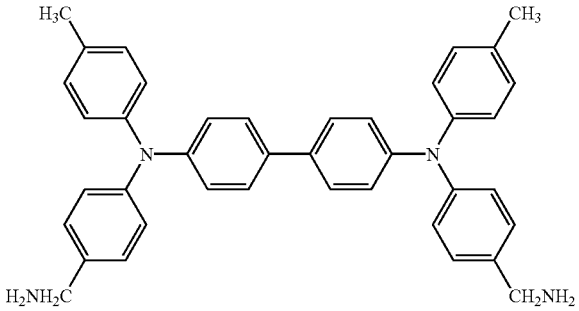

W-5

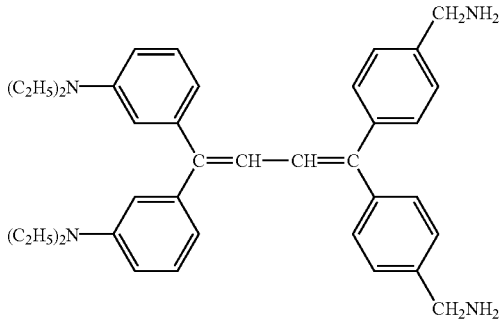

W-6

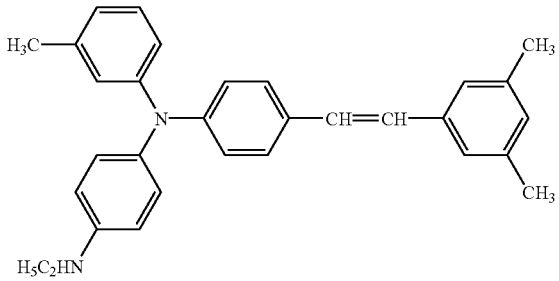

Of charge transportable compounds having an amino group, in the case of primary amine compounds (—$NH_2$), two hydrogen atoms may react with the organic silicone compound, and bonding to the siloxane structure may take place. In the case of secondary amine compounds (—$NHR_{10}$), one hydrogen atom may react with the organic silicone compound, and the remaining $R_{10}$ may be any of a remaining group as a branch, a group resulting in a crosslinking reaction, or a compound group having charge transportability.

Further, transportable compounds having a group containing silicone atom are illustrated below.

The charge transportable compounds having a group containing silicone atom are charge transport compounds having following structure. The compound is contained in a polysiloxane hardenable resin as a partial structure through silicone atom in the molecule.

$$X—(—Y—Si(R_{11})_{3-a}(R_{12})_a))n$$

wherein

X: a group containing structural unit providing charge transportability, $R_{11}$: hydrogen atom, a substituted or unsubstituted alkyl group, a substituted or an unsubstituted aryl group, $R_{12}$: hydrolysable group or a hydroxy group, Y: a substituted or unsubstituted alkylene group, a substituted or an unsubstituted arylene group, a: an integer of 1 to 3, and n: an integer.

Raw materials of the siloxane resin: The compounds represented Formula A through D (hereinafter referred to A through D) respectively. The ratio of those is preferably to use organic silicon compound: from 0.05 to 1 moles of C+D component per 1 mole of A+B component.

When colloidal silica E is added, it is preferable to use from 1 to 30 parts by weight of E per 100 parts by weight of total amount of A+B+C+D component.

The adding amount of the reactive charge transportable compound F capable of forming the resin layer by reacting with the organic silicon compound and the colloidal silica is preferably from 1 to 500 parts by weight per 100 parts by weight of the total amount of the component of A+B+C+D. When the amount of A+B component is smaller than the above-mentioned range, the hardness of the siloxane resin layer is shortened since the cross-linking density is too low. When the amount of A+B component is too large, the hardness of the layer is sufficient but the layer is become fragile. A shortage and an excess of the colloidal silica component E show similar effects to those of the component A+B, respectively. A too small amount of component F causes lowering in the sensitivity and raising in the remained potential since the charge transporting ability of the siloxane resin layer is become too low. When the amount of component F is excessive, the strength of the resin layer tends to be lowered.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Usually, the three-dimensional network structure can be formed by a condensation reaction of a composition containing alkoxysilane or alkoxysilane and colloidal silica.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octenate, dibutyl tin dictate, dibutyl tin dilaurate, dibutyl tin mercaptide, dibutyl tin thiocarboxylate and dibutyl tin maleate, an aluminum or zinc salt of octenoic acid or naphthenic acid and an acetylacetone complex.

Further, antioxidants having a partial structure of hindered phenol, hindered amine, thioether, or phosphite may be incorporated into the resin layer of the present invention, and are effective for the improvement of potential stabilization during ambient variation, as well as image quality.

The hindered phenols as described herein means compounds having a branched alkyl group in the ortho position relative to the hydroxyl group of a phenol compound and derivatives thereof. (However, the hydroxyl group may be modified to an alkoxy group.)

Further, listed as hindered amines are compounds having an organic group represented by the following structural formula:

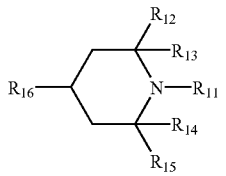

wherein $R_{11}$ represents a hydrogen atom or a univalent organic group, $R_{12}$, $R_{13}$, $R_{14}$, and $R_{15}$ each represents an alkyl group, and $R_{16}$ represents a hydrogen atom, a hydroxyl group, or a univalent organic group.

Listed as antioxidants having a partial hindered phenol structure are compounds described in Japanese Patent Publication Open to Public inspection No. 1-118137 (on pages 7 to 914).

Listed as antioxidants having a partial hindered amine structure are compounds described in Japanese Patent Publication Open to Public Inspection No. 1-118138 (on pages 7 to 9).

Examples of antioxidant available on the market include the followings.

Hindered phenol type antioxidant: Ilganox 1076, Ilganox 1010, Ilganox 1098, Ilganox 245, Ilganox 1330, Ilganox 3114, and 3,5-di-t-butyl-4-hydroxybiphenyl Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63

Thioether type antioxidant: Sumilizer TPS and Sumilizer TP-D

Phosphite type antioxidant: Mark 2112, Mark PEP 8, Mark PEP 24G, Mark PEP 36, Mark 329K and Mark HP 10.

Among those, preferable are hindered phenol type and hindered amine type particularly.

The added amount of antioxidants is preferably between 0.1 and 100 weight parts per 100 weight parts of the total resin layer composition.

The layer configuration of the electrophotographic photoreceptor of the present invention is not particularly limited. However, the preferred configuration is one in which the resin layer of the present invention is applied onto a photosensitive layer, such as a charge generating layer, a charge transport layer, or a charge generating-transport layer (a single layer type photosensitive layer which has both functions of charge generation and charge transport). Further, each of said charge generating layer, charge transport layer or charge generating-charge transport layer may be comprised of a plurality of layers.

The charge generating materials (CGM) incorporated into the photosensitive layer of the present invention may be employed individually or in combination with a suitable binder resin to form a resin layer. The representative examples of the charge generating materials include, for example, pyrylium dyes, thiopyrylium dyes, phthalocyanine pigments, anthanthrone pigments, dibenzpyrenequinone pigments, pyranthrone pigments, azo pigments, trisazo pigments, disazo pigments, indigo pigments, quinacridone pigments, cyanine dyes etc.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

In the present invention, the ratio of the charge generating material in the charge generating layer to the binder resin is preferably between 1:5 and 5:1 in terms of weight ratio. Further, the thickness of the charge generating layer is preferably no more than 5 μm, and is more preferably between 0.05 and 2 μm.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 10:1 and 1:10 in terms of weight ratio.

The thickness of the charge transport layer is preferably between 5 and 50 μm, and is more preferably between 10 and 40 μm. Furthermore, when a plurality of charge transport layers are provided, the thickness of the upper charge transport layer is preferably no more than 10 μm, and is preferably less than the total layer thickness of the charge transport layer provided under the upper layer of the charge transport layer.

The hardenable siloxane resin layer may share the function of the aforementioned charge transport layer. However, the hardenable siloxane resin layer is preferably provided as another layer on a photosensitive layer such as a charge transport layer or a charge generating layer, or a single layer type charge generating-transport layer. In such cases, an adhesive layer is preferably provided between the aforementioned photosensitive layer and the resin layer of the present invention.

Next, listed as an electrically conductive support of the electrophotographic photoreceptor of the present invention 1) metal plates such as an aluminum plate, a stainless steel plate, and the like
2) those in which a thin layer of metal such as aluminum, palladium, gold, and the like is provided on a support such as paper, plastic film, and the like, employing lamination or vacuum evaporation
3) those in which the layer of an electrically conductive compound such as an electrically conductive polymer, indium oxide, tin oxide, and the like is provided on a support such as paper, plastic film, and the like, employing coating or vacuum evaporation, and the like.

Employed mainly as materials for the electrically conductive support employed in the present invention are metals such as aluminum, copper, brass, steel stainless steel, and the like, as well as plastics. Any of these is processed in a belt shape or drum shape, and then employed. Commonly thin-walled cylindrical aluminum tubes produced by extrusion or drawing are frequently employed.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

The photosensitive layer is prepared by heat drying at temperature of more than 50° C. or higher, preferably 60 to 200° C. after forming the surface layer by coating. The residual coating solvent can be reduced and at the same time, the hardenable layer can be hardened sufficiently.

In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (nylon 6, nylon 66, nylon 610, copolymerized nylon, alkoxymethylated nylon, etc.), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 μm, and is most preferably between 0.1 and 5 μm.

In the photoreceptor of the invention a conductive layer may be provided between the support and the inter layer for the purposes of providing a coating to compensate surface defects of the surface of the support and preventing of occurrence of interference mottle which becomes problematic when the image writing source is laser light. The conductive layer can be formed by coating a composition in which conductive powder such as carbon black, metal particles or metal oxide particles are dispersed in suitable binder resin and drying it. The thickness of the conductive layer is preferably 5 to 40 μm, particularly 10 to 30 μm.

The electrophotographic photoreceptor of the present invention may generally be applied to electrophotographic apparatuses such as copiers, laser printers, LED printers, liquid crystal shutter printers, etc. In addition, it may widely be applied to apparatuses for display, recording, offset printing, plate making, facsimile, to which electrophotographic techniques are applied.

Next, described is a case in which fatty acid metal salts are supplied to the photoreceptor surface via the auxiliary cleaning member.

FIG. 1 is a cross-sectional view of an example in which the solid member comprised of fatty acid metal salts is employed as the flicker of a brush roller.

In FIG. 1, a photoreceptor is brought into contact with cleaning blade 6 and brush roller 4 positioned downstream (in the rotational direction of said photoreceptor) from said cleaning blade 6. A solid member comprised of fatty acid metal salts is employed as flicker 3 to dust and remove the toner on said brush, and the aforementioned fatty acid metal salts can be supplied to the photoreceptor surface from said flicker via said brush roller. Further, in FIG. 1, reference numeral 1 is a photoreceptor, 2 is a cylindrical brush support, 5 is a brush roller positioning member, and 7 is a cleaning blade positioning member. As a method other than this, fatty acid metal salts are penetrated into the mesh of cloth, which may be brought into contact with the photoreceptor surface as a web roller instead of said brush roller.

Further, the cleaning blade is most preferably made of urethane rubber. Of types of urethane rubber, polyurethane rubber having an impact resilience of 20 to 60 (at 20° C. and 50±5% RH) is preferred. When the impact resilience is below 20, sufficient cleaning properties are not obtained, while when it exceeds 60 percent, the blade tends to curl up (the physical values of urethane rubber are subject to JIS-K6301.)

Figure 2:
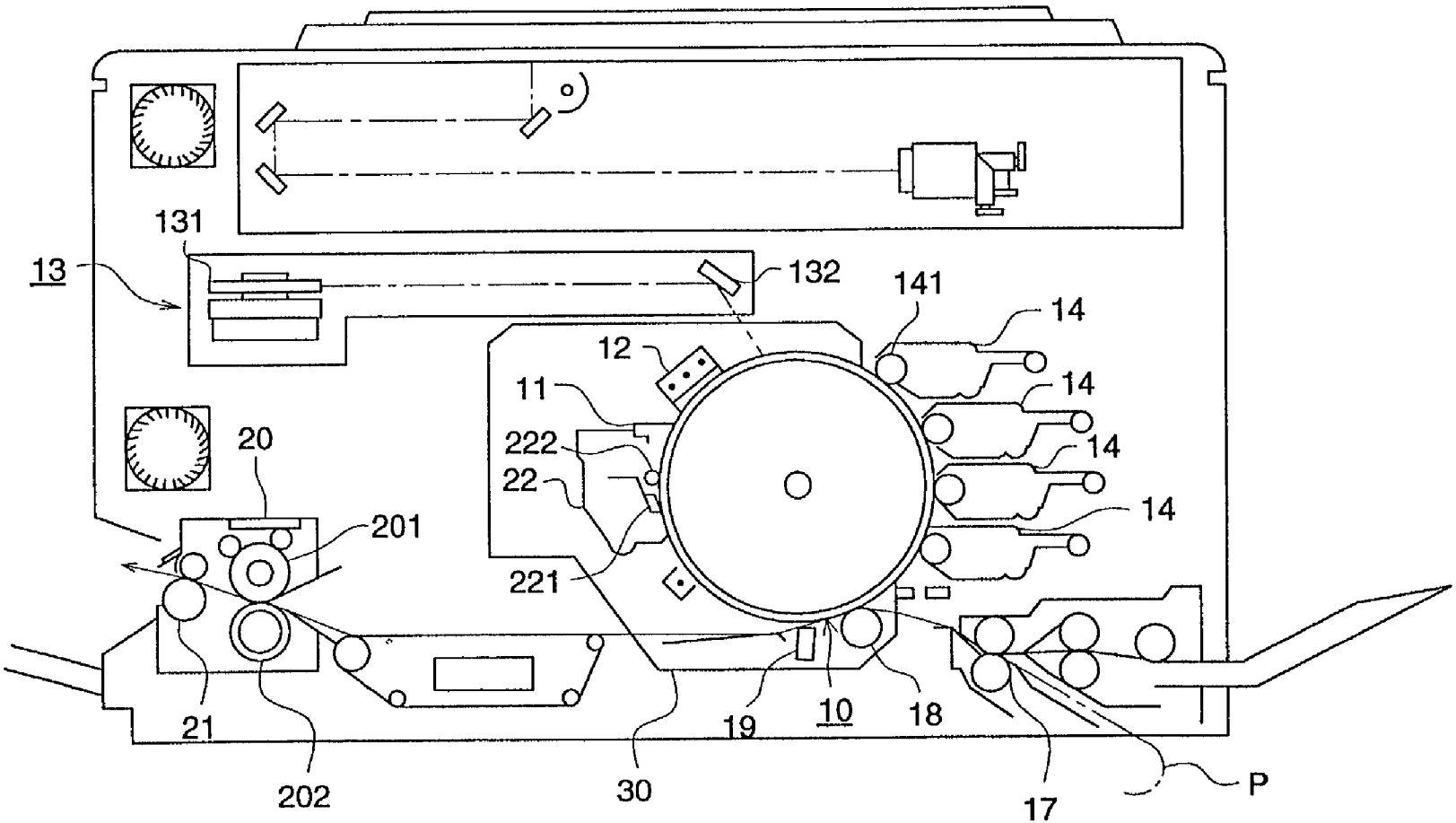
FIG. 2 is a cross-sectional view showing an example of an image forming apparatus comprising the electrophotographic photoreceptor of the present invention.

FIG. 2 shows a cross-sectional view of an image forming apparatus comprising the electrophotographic photoreceptor of the present invention.

In FIG. 2, reference numeral 10 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 11 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 2 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 10, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means, which is not shown in the figure, so as to form a layer having a thickness of 100 to 600 μm on the development sleeve, and conveyed to a development zone to achieve development. At the time, development is generally carried out by applying direct current and/or alternative current bias voltage to the gap between the photoreceptor drum 10 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 10.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 10 in synchronized transfer timing, and multicolor images are simultaneously transferred onto the recording sheet which is appropriately placed.

Subsequently, the recording sheet is subjected to charge elimination employing separation brush (in the separation unit) 19 which is brought into pressure contact at almost the same time when the transfer roller is brought into pressure contact, is separated from the circumferential surface of the photoreceptor drum 10, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 10 and are prepared for the subsequent formation of a new toner image.

On the other hand, the photoreceptor drum 10, from which the recording sheet P has been separated, is subjected to removal and cleaning of the residual toner through pressure contact of the blade 221 of cleaning unit 22, is again subjected to charge elimination employing the exposure section 11, subjected to recharging employing the charging unit 12, and subjected to a subsequent image forming process. Further, when color images are formed upon being superimposed on the photoreceptor, the above-mentioned blade 221 is immediately withdrawn after cleaning the photoreceptor surface of the photoreceptor drum.

Further, reference numeral 30 is a detachable cartridge in which a photoreceptor, a transfer unit, a separation unit, and a cleaning unit are integrated.

The electrophotographic image forming apparatus is constituted in such a manner that components such as the above-mentioned photoreceptor, development unit, cleaning unit the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

EXAMPLES

The present invention will be detailed with reference to examples.

Examples 1 through 7 and Comparative Examples 1 and 2

(1) Preparation of Photoreceptors 1 through 4

Employed as an electrically conductive support was a diameter 80 mm and height 355 mm aluminum support with a surface roughness Rz (10-point average roughness) of 1.5 μm.

<Interlayer>

| | |
|---|---|
| Titanium chelate compound (TC-750, manufactured by Matsumoto Seiyaku) | 30 g |
| Silane coupling agent | 17 g |
| 2-Propanol | 150 ml |

were mixed and dissolved to prepare an interlayer coating composition. The resultant coating composition was applied onto a cylindrical aluminum base body employing a dip coating method, and subsequently dried at 120° C. for one hour to form a 1.5 μm thick interlayer.

<Charge Generating Layer>

| | |
|---|---|
| Titanyl phthalocyanine | 60 g |
| Silicone resin solution (KR5240, 15% xylene-butanol solution, manufactured by Shin-Etsu Kagaku Co.) | 700 g |
| 2-Butanone | 2000 ml |

were mixed and dispersed for 10 hours employing a sand mill to prepare a charge generating layer coating composition. The resultant coating composition was applied onto said interlayer employing a dip coating method to form a 0.2 μm thick charge generating layer.

<Charge Transport Layer>

| | |
|---|---|
| Charge transport material (D1) | 200 g |
| Bisphenol Z type polycarbonate (Ubiron Z300, manufactured by Mitsubishi Gas Kagaku Co.) | 300 g |
| 1,2-Dichloroethane | 2000 ml |

were mixed and dissolved to prepare a charge transport layer coating composition. The resulting coating composition was applied onto the aforementioned charge generating layer employing a dip coating method to prepare a charge transport layer having a thickness shown in Table 1.

D1

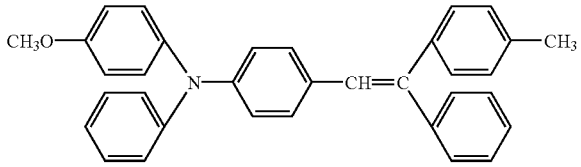

<Surface Layer>

| | |
|---|---|
| Trimethoxymethylsilane | 180 g |
| 1-Butanol | 280 ml |
| 1% aqueous acetic acid solution | 106 ml |

were mixed. After stirring the resulting mixture at 60° C. for 2 hours, 370 ml of 1-butanol was further added and the resulting mixture was stirred for 48 hours.

Added to the resulting mixture were 67.5 g of dihydroxymethyltriphenylamine (Exemplified Compound T-1), 1.7 g of an antioxidant (Sanol LS2626, manufactured by Sankyo Co.), and 4.5 g of dibutyl tin acetate, and mixed. The resulting mixture was applied to form a surface layer having a dry layer thickness of 1 μm, and the coated layer was thermally hardened at 120° C. for one hour to prepare Photoreceptor 1.

Subsequently, Photoreceptor 2 was prepared in the same manner as Photoreceptor 1, except that dihydroxytriphenylamine (T-1) in the surface layer of Photoreceptor 1 was replaced with 4-[2-(triethoxysilyl)ethyl]triphenylamine.

Next, Photoreceptor 3 was prepared in the same manner as Photoreceptor 1, except that the antioxidant in the surface layer of Photoreceptor 1 was removed.

Further, Photoreceptor 4 was prepared in the same manner as Photoreceptor 1, except that dihydroxytriphenylamine (T-1) in the surface layer of Photoreceptor 1 was removed.

<Preparation of Photoreceptor 5>

In the same manner as Photoreceptor 1, the sublayer, the charge generating layer, and the charge transport layer were formed on a support.

<Surface Layer>

| | |
|---|---|
| Trimethoxymethylsilane | 180 g |
| Ethanol | 650 ml |
| 2% aqeous acetic acid solution | 50 ml |

were mixed and stirred at room temperature for 20 hours. Added to the resulting mixture were 67.5 g of hydroxymethyltriphenylamine (Exemplified Compound T-1), 60 g of methanol silica sol (30% methanol solution, manufactured by Nissan Kagaku Co.), 1.7 g of an antioxidant, and 1.35 g of aluminum acetylacetonate (manufactured by Kawaken Chemical Co.), and mixed. The resulting mixture was applied to form a surface layer having a dry layer thickness of 2 μm, and the coated layer was thermally hardened at 110° C. for one hour to prepare Photoreceptor 5.

By this process, the surface layer of Photoreceptor 5 contains colloidal silica.

<Preparation of Photoreceptor 6>

Photoreceptor 6 was prepared in the same manner as Photoreceptor 1, except that the surface layer of Photoreceptor 1 was not applied.

Of the photoreceptors described above, Photoreceptor 4 is comprised of the surface layer which has not been hardened. Further, in Photoreceptor 6, the charge transport layer in Photoreceptor 1 is employed as an uppermost layer, and namely, said uppermost layer is formed employing a layer which is formed employing a polycarbonate binder in conventional photoreceptors.

(2) Preparation of Developer Material

A developer material, comprised of the toner and the carrier described below, was prepared.

<Toner>

| | |
|---|---|
| Styrene-acrylic copolymer resin | 100 g |
| Carbon black | 10 g |
| Wax | 4 g |
| Fine silica powder | 1 g |

Fatty acid metal salt (Table 1 shows types and amounts)

The aforementioned styrene-acrylic copolymer resin, carbon black, and wax were melted, kneaded, and pulverized to obtain colored particles having a volume average particle diameter of 8.5 μm. Fine silica powder as well as the fatty acid metal salt was then add-mixed to the resulting colored particles to obtain toner particles.

Carrier

An acrylic resin coated ferrite carrier having a particle diameter of 70 μm was employed.

<Developer Material>

The aforementioned toner and carrier were mixed so that the toner concentration was 5 percent by weight.

(3) Image Forming Apparatus

Examples 1 through 7, and Comparative Examples 1 and 2 were prepared by combining photoreceptors and toner prepared as described above and as shown in Table 1. Each of them was mounted on a modified digital copier "Konica 7050" and was evaluated.

For cleaning, a polyurethane-made elastic rubber blade having a rubber hardness of JIS A 70°, an impact resilience of 25, a thickness of 2 mm, and a free length of 9 mm was brought into contact with a photoreceptor at a contact angle of 20° under a dead weight loading type pushing pressure of 20 g/cm in the direction counter to the rotational direction of said photoreceptor.

Further, a roller was produced in such a manner that an electrically conductive acrylic brush having a single fiber size of 15 denier and a fiber density of $9.3\times10^2$ f/cm$^2$ was mounted on a diameter 6 mm core metal made of SUS so as to form an outer diameter of 15 mm. The produced brush was installed on the lower part of the aforementioned blade so as to obtain a bite of 1 mm and was set to be operated in synchronization with a photoreceptor at a rotational frequency of 500 rpm in the forward direction with respect to said photoreceptor. Further, at the same time, a SUS-made flicker to dust and remove toner was provided so as to obtain a bite of 1 mm with respect to said brush.

At 30° C. and 80% RH (high temperature and high humidity), a test was carried out in which 50,000 copies were practically prepared. The quality (evaluation of density and background staining) of the copied images, curl of the blade, and the presence of residual toner were evaluated.

Image Evaluation

A: good

Figure 3:
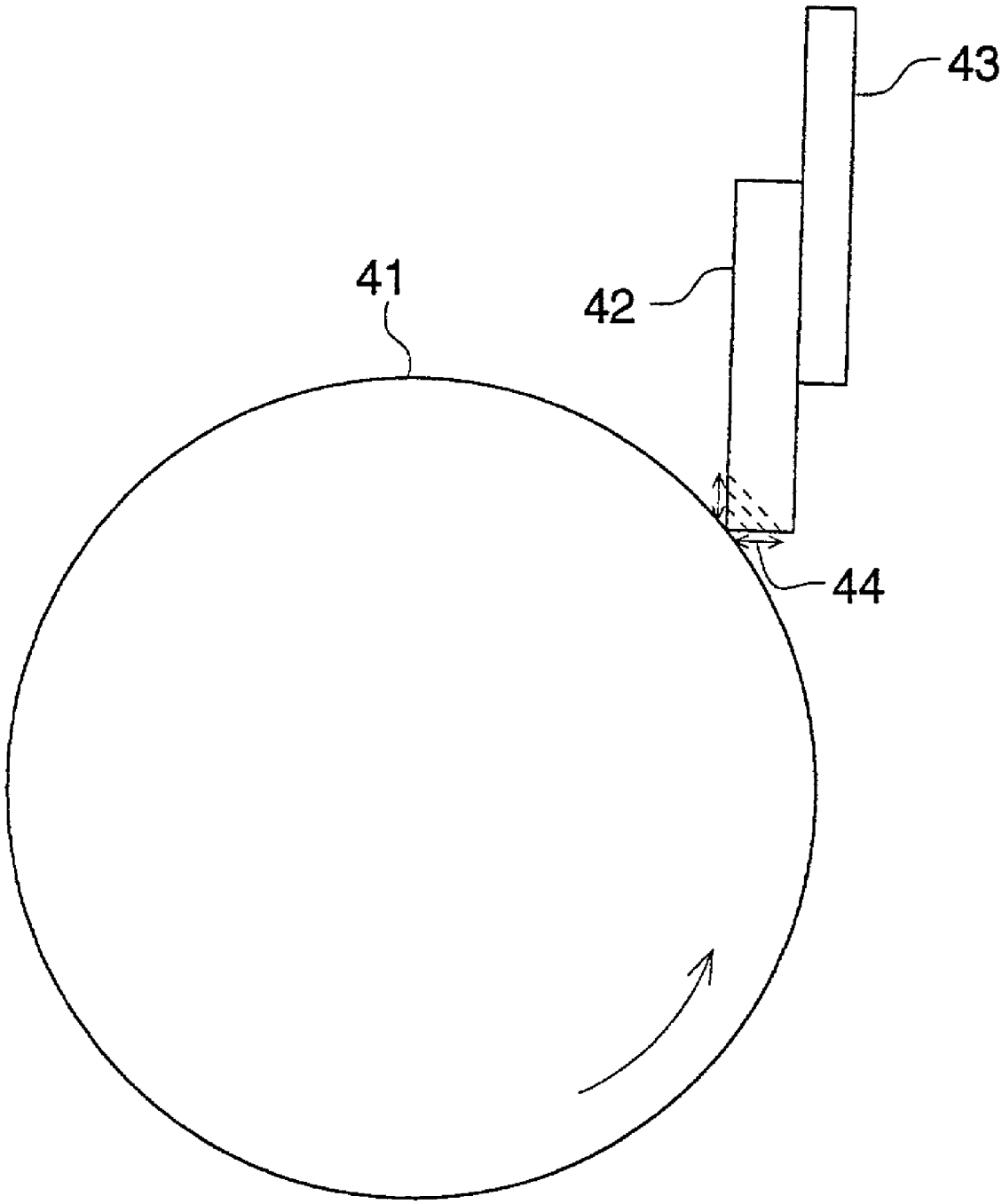
FIG. 3 is a schematic view showing a measurement method of the abraded dimension of the cleaning blade edge.

B: image quality problems were observed, but were commercially viable c: image quality problems were observed and were not commercially viable Measurement Method of Abraded Dimension of Cleaning Blade Edge FIG. 3 is a schematic view explaining a measurement method of the abraded dimension of a cleaning blade edge. Abraded portion 44 of the cleaning blade edge, shown in FIG. 3 is enlarged employing an optical or laser microscope and the abraded dimension is measured employing the resulting images.

In FIG. 3, reference numeral 41 is a photoreceptor drum, 42 is a cleaning blade, 43 is a cleaning blade supporting metal, and 44 is an abraded dimension.

The results described above show the following: As found in the results of Comparative Examples 3 and 4, the combinations of the conventional photoreceptor surface (Photoreceptor 6) with fatty acid metal salts resulted in background stain as well as the curl of the blade. Specifically, in Comparative Example 3, in spite of employing the fatty acid metal salt, the curl of the blade occurred. It is estimated that the affinity of the conventional photoreceptor surface with

TABLE 1

| Example No. | Photo-receptor No. | Fatty Acid Metal Salt in Toner (added amount in g) | Bleeding Rate of Fatty Acid Metal Salt (in ml/sec) | Abraded Dimension of Blade (in μm) | Image Evaluation Density | Image Evaluation Back-ground Stain | Image Evaluation Curl of Blade and Residual Toner |
|---|---|---|---|---|---|---|---|
| 1 | 1 | zinc stearate | $6.7 \times 10^{-2}$ | 18 | A | A | neither curl nor residual toner was observed |
| 2 | 1 | aluminum stearate | $6.4 \times 10^{-2}$ | 28 | A | A | neither curl nor residual toner was observed |
| 3 | 1 | magnesium stearate | $6.9 \times 10^{-2}$ | 20 | A | A | neither curl nor residual toner was observed |
| 4 | 1 | sodium stearate | $1.0 \times 10^{-2}$ | 34 | A | B | slight residual toner was observed |
| 5 | 2 | zinc stearate | $6.7 \times 10^{-2}$ | 8 | A | B | neither curl nor residual toner was observed |
| 6 | 1 | zinc stearate | $6.7 \times 10^{-2}$ | 28 | A | A | neither curl nor residual toner was observed |
| 7 | 3 | zinc stearate | $6.7 \times 10^{-2}$ | 25 | B | B | slight curl was partially observed |
| 8 | 5 | zinc stearate | $6.7 \times 10^{-2}$ | 5 | A | A | neither curl nor residual toner was observed |
| Comparative Example 1 | 1 | none | | 52 | C | C | both curl and residual toner were observed |
| Comparative Example 2 | 4 | zinc stearate | $6. \times 10^{-2}7$ | 58 | B | C | curl was observed |
| Comparative Example 3 | 6 | zinc stearate | $6.7 \times 10^{-2}$ | 50 | B | C | slight curl was partially observed |
| Comparative Example 4 | 6 | none | | 71 | C | C | both curl and residual toner were observed |

the fatty acid metal salt is low and it is difficult to consistently form a thin fatty acid metal salt layer.

Further, as shown in Comparative Example 2, the addition of the fatty acid metal salt to an unhardened surface layer (Photoreceptor 4) does not completely overcome the problems, though the photoreceptor is different from a conventional one.

Further, as shown in Comparative Example 1, it is found that though there is a surface layer (Photoreceptor 1), which is different from a conventional photoreceptor, the photoreceptor itself without fatty acid metal salts is not capable of overcoming image and blade problems.

Contrary to this, it is found (in Examples Nos. 1 through 8) that combinations of the surface layer (Photoreceptor 1), different from the conventional photoreceptor with fatty acid metal salts, exhibit peculiar effects which are not exhibited by conventional combinations.

Figure 4:
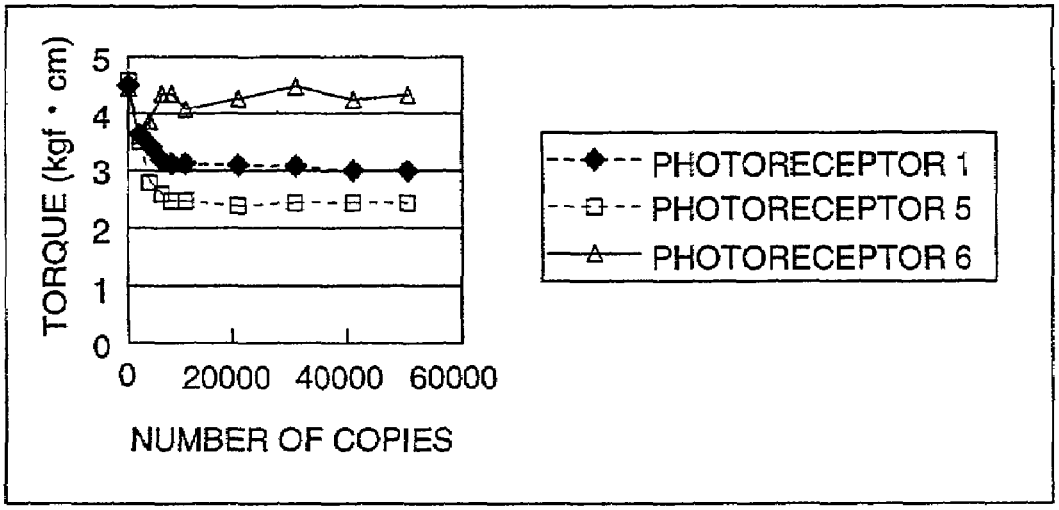
FIG. 4 is a graph showing results of examples comprising fatty acid metal salts.
Figure 5:
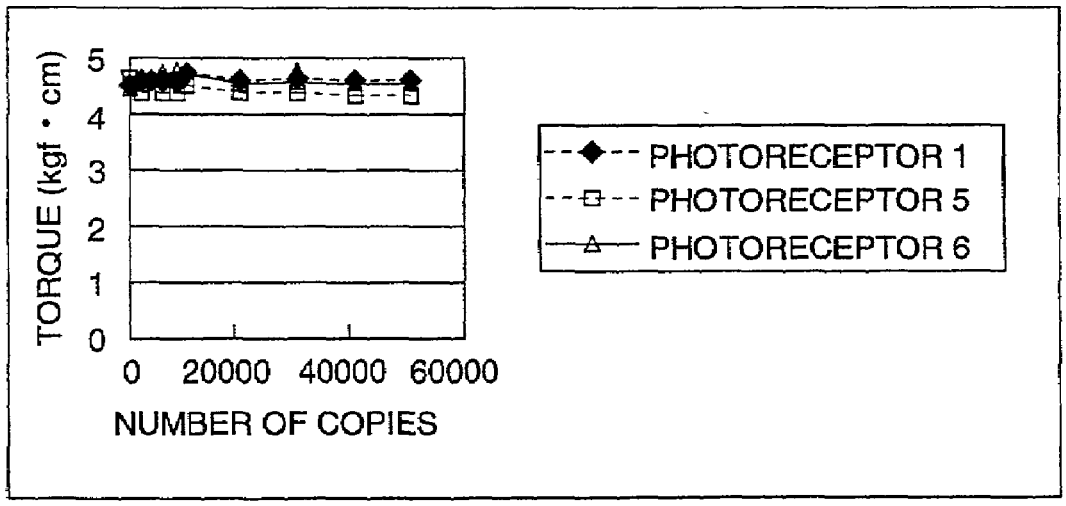
FIG. 5 is a graph showing results of examples which do not comprise fatty acid metal salts.

Employing Photoreceptors 1, 5 and 6, variations of a blade torque were measured during repeated image formation with the presence and non-presence of fatty acid metal salts. At a high humidity as well as a high temperature employed in Examples 1 through 8, a test run was carried out in which 50,000 copies were practically produced. Further, the torque was measured as follows. A test run was suspended at definite intervals and a torque meter was connected to the rotational axis of the drum. Then, an external force was applied and the minimum torque (in kgf·cm), which is required to commence rotation of the drum from a standing start, was measured. FIGS. 4 and 5 show the results.

As can clearly be seen in FIG. 5, when fatty acid metal salts are not employed, high toque is generated in all of photoreceptors without fail and the friction of the cleaning blade against the photoreceptor and load provided to the cleaning blade are great.

On the other hand, as can be clearly seen in FIG. 4, it has been possible that by carrying out image formation, employing the photoreceptor having the resin layer of the present invention along with a developer material comprising fatty acid metal salts, the torque is consistently maintained in the lower range. As a result, during cleaning, the toner is fully removed and the blade does not curl. Thus, it is possible to provide excellent images for an extended period of time.

On the other hand, when the resin layer of the present invention is not employed, a decrease in torque is initially observed. However, it has been found that the variation of the torque is great and it is difficult to maintain the effects for a long period of time. It is found that when the torque variations are great, during repeated image formation, problems tend to occur such as curling of the blade, residual toner, and the like.

In the following, shown are examples (Examples 9 and 10), in which the cleaning blade as well as the brush roller was varied, and an example (Example 11), in which the subject of metal salts are varied.

Example 9

Evaluation was carried out in the same manner as Example 1, except that the cleaning blade employed in Example 1 was replaced with one of polyurethane having a rubber hardness of JIS A70°, an impact resilience of 65, a thickness of 2 mm, and a free length of 9 mm.

The abraded dimension of the blade was 38 μm after producing 50,000 copies. The blade curled slightly. However, the image quality was excellent.

Example 10

Evaluation of practical production of 50,000 copies was carried out in the same manner as Comparative Example 1, except that the SUS-made flicker of the brush roller employed in Comparative Example 1 was replaced with a zinc stearate rod having the same diameter, and the quality of copied images was evaluated.

The evaluation results were as follows. The abraded dimension of the blade after the test run of 50,000 copies was 24 μm. The blade did not curl and excellent image quality was obtained.

Example 11

A photoreceptor was prepared in the same manner as Comparative Example 1, except that 0.5 weight part of zinc stearate was added to the photoreceptor employed in Comparative Example 1. In the same manner as Comparative Example 1, 50,000 copies were produced and evaluated. The quality of copied images was evaluated.

The evaluation results were as follows. The abraded dimension of the blade after the test run of 50,000 copies was 35 μm. The blade did not curl and the image quality was excellent.

According to examples described above, it was possible to obtain excellent electrophotographic images on many sheets at an ambience of high temperature and high humidity by supplying fatty acid metal salts via a cleaning brush roller from a developer material to a surface layer comprising a charge transportable polysiloxane hardenable resin which is provided to an electrophotographic photoreceptor, or by incorporating said fatty metal salts into said surface layer itself.

The invention claimed is:

1. An image forming method comprising developing a latent image on an electrophotographic photoreceptor employing a toner having a volume average particle diameter of 2 to 15 μm;

transferring the toner from the photoreceptor to a recording material;

cleaning the photoreceptor with an elastic body cleaning blade to remove remaining toner on said photoreceptor, wherein said electrophotographic photoreceptor comprises a surface layer containing a charge transportable polysiloxane hardenable resin containing triarylamine structure which forms three-dimensional network structure, and said toner further comprises a fatty acid metal salt on the surface of the toner in an amount of 0.01 to 1 percent by weight based on the toner.

2. The image forming method of claim 1 wherein bleeding rate of the fatty acid metal salt measured employing a flow tester is at least $5.0\times10^{-4}$ ml/second.

3. The image forming method of claim 1 wherein the elastic body cleaning blade is composed of polyurethane rubber having an impact resilience of 20 to 60 at 20° C. and 50±5% RH.

4. The image forming method of claim 1 wherein surface layer comprises an antioxidant.

5. The image forming method of claim 1 wherein the charge transportable polysiloxane hardenable resin is a reaction product of an organic silicon compound having a hydroxyl group or a hydrolysable group with a charge transportable compound having a hydroxyl group.

6. The image forming method of claim 1 wherein the surface layer further contains colloidal silica.

7. The image forming method of claim 1 wherein the fatty acid metal salt is zinc stearate.

8. An image forming method comprising developing a latent image on an electro photographic photoreceptor employing a toner having a volume average particle diameter of 2 to 15 μm;

transferring the toner from the photoreceptor to a recording material;

cleaning the photoreceptor with an elastic body cleaning blade to remove remaining toner on the photoreceptor, wherein said electrophotographic photoreceptor comprises a surface layer containing a charge transportable polysiloxane hardenable resin containing triarylamine structure which forms three-dimensional network structure, and an image is formed while supplying a fatty acid metal salt to the surface of said photoreceptor from a fatty acid metal salt flicker via an auxiliary cleaning brush roller.

9. The image forming method of claim 8 wherein bleeding rate of the fatty acid metal salt measured employing a flow tester is at least $5.0\times10^{-4}$ ml/second.

10. The image forming method of claim 8, wherein the fatty acid metal salt is zinc stearate.

* * * * *